US005453665A

United States Patent [19]

Konopka

[11] Patent Number: 5,453,665

[45] Date of Patent: Sep. 26, 1995

[54] SINGLE TRANSISTOR ELECTRONIC BALLAST

[75] Inventor: John G. Konopka, Barrington, Ill.

[73] Assignee: Motorola, Inc., Schaumburg, Ill.

[21] Appl. No.: 277,929

[22] Filed: Jul. 20, 1994

[51] Int. Cl.[6] ..... H05B 41/00

[52] U.S. Cl. ..... 315/219; 315/224; 315/278; 315/DIG. 7

[58] Field of Search ..... 315/219, 278, 315/279, DIG. 7, 224, 208, DIG. 4, 307, 308, 206, 207, 220, 277

[56] References Cited

U.S. PATENT DOCUMENTS 3,973,165 8/1976 Hester ..... 315/105
4,958,109 9/1990 Naum ..... 315/307
5,138,236 8/1992 Bobel et al. ..... 315/209
5,144,204 9/1992 Nerone et al. ..... 315/209 R

*Primary Examiner*—Robert J. Pascal
*Assistant Examiner*—David H. Vu
*Attorney, Agent, or Firm*—J. Ray Wood

[57] ABSTRACT

An electronic ballast 10 includes a single transistor 16 that supports both power factor correction and inverter functionality. To assist in controlling voltages across this transistor 16 during all phases of operation, two dual function diodes 21 and 19 are provided.

9 Claims, 1 Drawing Sheet

SINGLE TRANSISTOR ELECTRONIC BALLAST

FIELD OF THE INVENTION

This invention relates generally to electronic ballasts.

BACKGROUND OF THE INVENTION

Electronic ballasts for gas discharge lamps are generally known in the art. Many prior art electronic ballasts that perform both power factor correction and inverter functionality include three or more power switches (in the form of transistors). Because the cost of transistors is relatively high, reducing the number of transistors may have a significant effect on the cost of the ballast.

Electronic ballast topologies using only a single transistor have been proposed. Imposing multiple tasks upon one transistor, however, gives rise to other problems and concerns. In particular, when such a transistor turns off, voltage across the transistor can rise greatly, therefore necessitating either the use of relatively expensive transistors that are able to withstand the voltage stresses imposed, or some form of protective circuit. Unfortunately, though effective to protect the transistor from excessive voltages, such snubber circuits are themselves relatively inefficient, and dissipate large quantities of heat.

Accordingly, a need exists for an electronic ballast that has the benefits of a one transistor topology without requiring either inefficient protection techniques or relatively expensive transistors.

DESCRIPTION OF A PREFERRED EMBODIMENT

Figure 1:
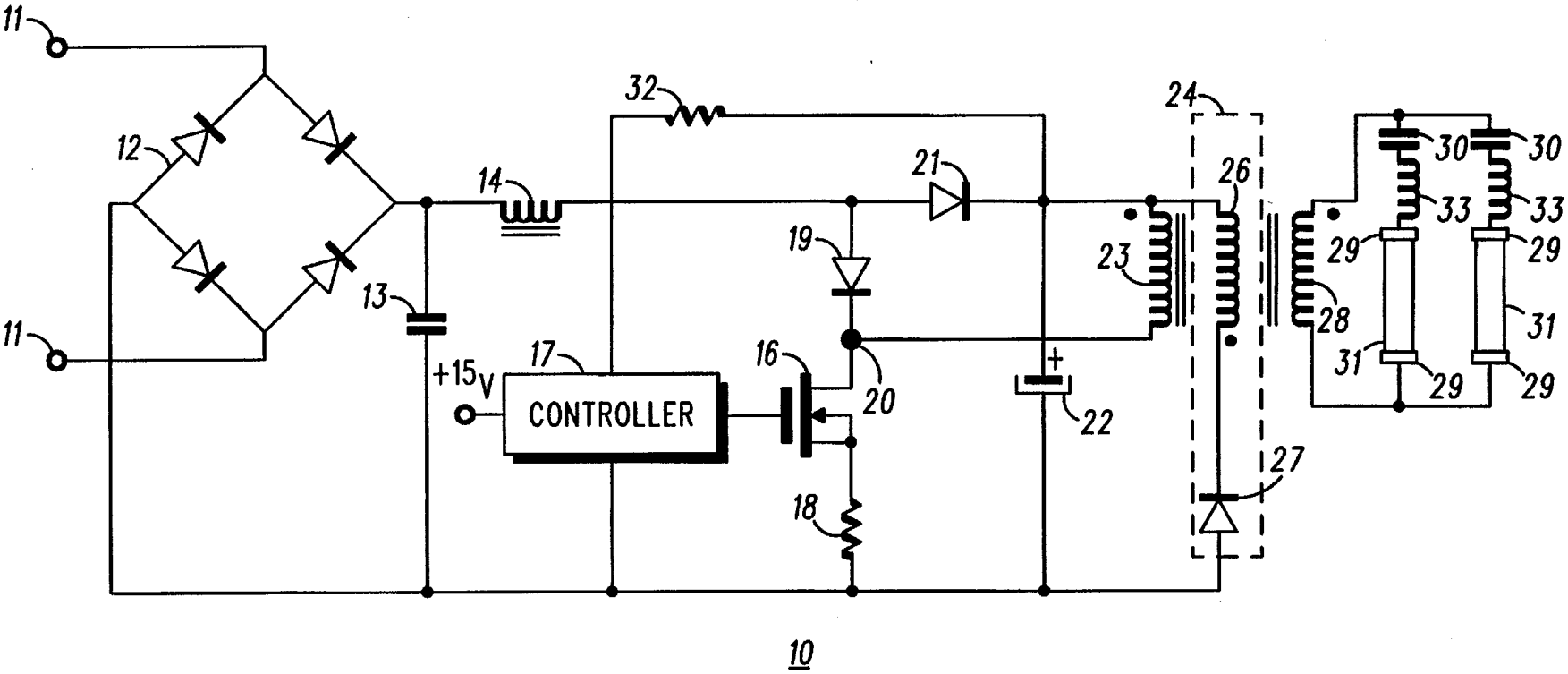
FIGURE 1 comprises a schematic depiction of an electronic ballast configured in accordance with this invention.

Referring now to the drawing, an electronic ballast 10 configured in accordance with the invention can be seen. The electronic ballast 10 includes terminals 11 that couple to a common 120 volt alternating current (AC) source. These terminals 11 also couple to a bridge rectifier 12 that full wave rectifies the AC signal to provide a pulsating direct current (DC) signal at the output thereof.

A 0.47 microfarad high frequency bypass capacitor 13 couples between the rectifier 12 and a boost inductor 14. The operation of these elements will be described below.

This electronic ballast 10 comprises a single transistor topology. In this embodiment, the single transistor comprises a dual function power transistor 16 provided here by a field effect transistor such as a MTP4N50. A controller 17 controls the switching of the dual function power transistor 16. In this particular embodiment, the controller 17 comprises a pulse width modulation integrated circuit such as a part number MC2845, as well understood in the art. A 0.43 ohm resistor 18 couples between the source of the dual function power transistor 16 and the circuit common. The drain of the dual function power transistor 16 couples through an isolation diode 19 to the boost inductor 14.

The boost inductor 14 also connects through a boost rectifier diode 21 to a 47 microfarad bulk energy storage capacitor 22, to the primary winding 23 of a transformer, and also to a clamping circuit 24. The clamping circuit 24 includes a series coupled clamp winding 26 that is part of the transformer and a diode 27. In this embodiment, the primary winding 23 and the clamp winding 26 have a one to one turns ratio, and have their polarity reversed with respect to one another, as indicated.

The transformer includes an additional secondary winding 28 that couples, by way of capacitor 30 and inductor 33, to parallel configured gas discharge lamp terminals 29. The Icad for the circuit is gas discharge lamps 31. Gas discharge lamps 31 are connectable to the gas discharge lamp terminals 29 in accordance with well understood prior art technique.

Lastly, 400K ohm feedback resistor 32 couples between the bulk energy storage capacitor 22 and the controller 17.

Operation of the electronic ballast 10 will now be described.

When the controller 17 causes the dual function power transistor 16 to close, the high frequency bypass capacitor 13 charges the boost inductor 14. In particular, the boost inductor 14 charges through a circuit that includes the bypass capacitor 13, the isolation diode 19, the dual function power transistor 16, and the resistor 18 coupled thereto.

At the same time, current flows from the bulk energy storage capacitor 22 through the primary winding 23 of the transformer, and the dual function power transistor 16, thereby causing energy to be stored in the primary winding 23.

When the controller 17 causes the dual function power transistor 16 to open, the boost inductor 14 releases its stored energy. Current therefore flows through the boost rectifier diode 21 to the bulk energy storage capacitor 22, thereby providing both boost and power factor correction action.

At the same time, the primary winding 23 releases its stored energy through inductive coupling to the secondary winding 28. In particular, a squarewave appears across the terminals of the secondary winding 28, the value of which is determined by the turns ratio between the primary winding 23 and the secondary winding 28. This squarewave is converted into a sine wave by a series resonant circuit comprised of the series connected capacitors 30 and inductors 33.

Energy from the primary winding 23 is also inductively released to the clamp winding 26. Because of the polarity difference between these two windings 23 and 26, voltage across the primary winding 23 rises quickly to a value substantially equal to twice the voltage as appears across the bulk energy storage capacitor 22. A voltage greater than this is absorbed by the clamp winding 26, with the associated clamp diode 27 becoming active such that the excess energy flows back to the bulk energy storage capacitor 22.

As noted earlier, the turns ratio between the primary winding 23 and the clamp winding 26 is one-to-one. Depending upon the particular application, this ratio may be greater, but should not be less than one-to-one. By maintaining the turns ratio as indicated, useful voltage levels are maintained while avoiding excessive stress on the dual function power transistor 16.

So configured, the isolation diode 19 and the boost rectifier diode 21 each serve a dual function. In particular, the isolation diode 19 blocks current from the primary winding 23 from flowing back to the boost inductor 14, thereby assuring that energy as stored by the primary winding 23 is transferred instead to the clamp winding 26 and secondary winding 28 as described above. As a second function, the isolation diode 19 allows the voltage at node 20 to be greater than the voltage across capacitor 22.

The boost rectifier diode 21 prevents current from the bulk energy storage capacitor 22 from flowing to ground, and couples the leading edge voltage transient to the energy storage capacitor 22 such that no voltage greater than twice the voltage on the capacitor 22 is across transistor 16.

So configured, an electronic ballast having one dual function power transistor can be provided wherein the various elements described cooperate to ensure that voltages across the dual function power transistor 16 do not rise above useful levels, thereby ensuring both proper operation of the electronic ballast 10 and the compatibility of the topology with less expensive transistors.

What is claimed is:

1. An electronic ballast having one dual function power transistor and a bulk energy storage capacitor that provides power to a load when line voltage drops below a predetermined value, the electronic ballast comprising:

A) a boost inductor operably coupled to both the dual function power transistor and the bulk energy storage capacitor, such that when the dual function power transistor opens, energy from the boost inductor is transferred to the bulk energy storage capacitor;

B) a transformer having:

a primary winding operably coupled to both the dual function power transistor and the bulk energy storage capacitor;

a secondary winding operably coupled to at least one pair of gas discharge lamp terminals;

a clamping circuit that is coupled to the bulk energy storage capacitor and that is inductively coupled to the primary winding;

C) a first dual function diode that is connected to the dual function power transistor, the boost inductor, and the primary winding, such that, when the dual function power transistor is opened, a voltage across the primary winding is allowed to increase to a potential that is no greater than a predetermined amount but at least greater than 2 times the voltage across the bulk energy storage capacitor; and D) a second dual function diode that is operably coupled to the boost inductor, the dual function power transistor, the bulk energy storage capacitor, and the primary winding of the transformer, such that:

when the dual function power transistor is open and energy has been transferred from the boost inductor to the bulk energy storage capacitor, energy will not thereafter be transferred from the bulk energy storage capacitor to the boost inductor;

when the dual function power transistor is closed, energy will not flow from the bulk energy storage capacitor to the dual function power transistor.

2. The electronic ballast of claim 1, wherein the primary winding is directly coupled to the dual function power transistor.

3. The electronic ballast of claim 1, wherein the primary is directly coupled to the bulk energy storage capacitor.

4. The electronic ballast of claim 1, wherein the primary is directly coupled to both the dual function power transistor and the bulk energy storage capacitor.

5. The electronic ballast of claim 1, wherein the clamping circuit includes an inductively coupled clamp winding.

6. The electronic ballast of claim 5, wherein the clamping circuit further includes a diode coupled in series with the inductively coupled clamp winding.

7. The electronic ballast of claim 5, wherein the inductively coupled clamp winding has a one to one turns ratio with respect to the primary winding.

8. The electronic ballast of claim 5, wherein the inductively coupled clamp winding and the primary winding have opposite polarities.

9. An electronic ballast having:

one dual function power transistor that supports both power factor correction and conversion of direct current to alternating current suitable to drive a gas discharge lamp, and a bulk energy storage capacitor that provides power to at least one gas discharge lamp when line voltage drops below a predetermined value, the electronic ballast comprising:

A) a boost inductor operably coupled to both the dual function power transistor and the bulk energy storage capacitor, such that when the dual function power transistor opens, energy from the boost inductor is transferred to the bulk energy storage capacitor;

B) a transformer having:

a primary winding operably coupled to both the dual function power transistor and the bulk energy storage capacitor;

a secondary winding operably coupled to at least one pair of gas discharge lamp terminals;

a clamping circuit that is connected to the bulk energy storage capacitor and that is inductively coupled to the primary winding;

C) a first dual function diode that is connected to the dual function power transistor, the boost inductor, and the primary winding, such that, when the dual function power transistor is opened, a voltage across the primary winding is allowed to increase to a potential that is no greater than a predetermined amount but at least greater than 2 times the voltage across the bulk energy storage capacitor;

D) a second dual function diode that is operably coupled to the boost inductor, the dual function power transistor, the bulk energy storage capacitor, and the primary winding of the transformer, such that:

when the dual function power transistor is open and energy has been transferred from the boost inductor to the bulk energy storage capacitor, energy will not thereafter be transferred from the bulk energy storage capacitor to the boost inductor;

when the dual function power transistor is closed, energy will not flow from the bulk energy storage capacitor to the dual function power transistor.

* * * * *